US011339534B2

(12) United States Patent
Gleich

(10) Patent No.: US 11,339,534 B2
(45) Date of Patent: May 24, 2022

(54) MULTI-LAYER WARP BOUND PAPERMAKER'S FORMING FABRICS

(71) Applicant: Huyck Licensco Inc., Youngsville, NC (US)

(72) Inventor: Renate Gleich, Dußlingen (DE)

(73) Assignee: Huyck Licensco Inc., Youngsville, NC (US)

( * ) Notice: Subject to any disclaimer, the term of this patent is extended or adjusted under 35 U.S.C. 154(b) by 0 days.

(21) Appl. No.: 17/016,627

(22) Filed: Sep. 10, 2020

(65) Prior Publication Data

US 2021/0079595 A1 Mar. 18, 2021

Related U.S. Application Data

(60) Provisional application No. 62/901,937, filed on Sep. 18, 2019.

(51) Int. Cl.

| | |
|---|---|
| ***D21F 7/08*** | (2006.01) |
| ***D21F 7/10*** | (2006.01) |
| ***D03D 1/00*** | (2006.01) |

(52) U.S. Cl.

CPC ..... *D21F 7/083* (2013.01); *D03D 1/00* (2013.01); *D21F 7/10* (2013.01)

(58) Field of Classification Search

CPC ..... D21F 7/083; D21F 7/10; D21F 1/0036; D21F 1/0045; D03D 1/00

See application file for complete search history.

(56) References Cited

U.S. PATENT DOCUMENTS

| | | | |
|---|---|---|---|
| 4,605,585 | A | 8/1986 | Johansson |
| 4,945,952 | A | 8/1990 | Fritz |

(Continued)

FOREIGN PATENT DOCUMENTS

| | | |
|---|---|---|
| EP | 0698682 | 2/1996 |
| EP | 0961853 B1 | 6/2002 |

(Continued)

OTHER PUBLICATIONS

"International Search Report and Written Opinion corresponding to International Patent Application No. PCT/US2020/050849, dated Dec. 24, 2020".

*Primary Examiner* — Jacob T Minskey
*Assistant Examiner* — Matthew M Eslami
(74) *Attorney, Agent, or Firm* — Myers Bigel, P.A.

(57) ABSTRACT

The present invention is directed to forming fabrics. The forming fabrics may include a series of repeat units. Each of the repeat units may include a set of binding warp yarns including a first set of binding warp yarns and a second set of binding warp yarns, wherein a binding warp yarn from the first set is paired with a binding warp yarn from the second set; a set of spring warp yarns, wherein each spring warp yarn is between a first pair of binding warp yarns and a second pair of binding warp yarns; a set of top weft yarns including odd and even top weft yarns, wherein the top weft yarns interweave with the binding warp yarns and the spring warp yarns to form a top fabric layer, wherein the spring warp yarns interweave only with the top weft yarns; a set of bottom weft yarns; and a set of bottom warp yarns, the bottom warp yarns interwoven with the bottom weft yarns to form a bottom fabric layer. The binding warp yarns from the first and second set and the spring warp yarns interweave with the top weft yarns to relatively form a plain weave pattern in defined zones such that (a) the first set of binding warp yarns only pass over even top weft yarns; (b) the second set of binding warp yarns only pass over odd top weft yarns; (c) the first binding warp yarn in the pair is offset from the second binding warp yarn in the pair by at least three top weft yarns to create an overlap in the warp path of the pair of binding warp yarns; and (d) each spring warp yarn passes over even and odd top weft yarns. The binding warp yarns (Continued)

from the first and second set and the bottom warp yarn interweave with the bottom weft yarns.

20 Claims, 9 Drawing Sheets
(3 of 9 Drawing Sheet(s) Filed in Color)

(56) References Cited

U.S. PATENT DOCUMENTS

| | | | | |
|---|---|---|---|---|
| 5,092,372 | A | 3/1992 | Fitzka et al. | |
| 5,152,326 | A | 10/1992 | Fritz | |
| 6,179,013 | B1 | 1/2001 | Gulya | |
| 7,059,357 | B2 | 6/2006 | Ward | |
| 7,441,566 | B2 | 10/2008 | Ward | |
| 7,717,141 | B1 * | 5/2010 | Quigley | D21F 1/0036 139/383 A |
| 8,196,613 | B2 | 6/2012 | Ward | |
| 2006/0048840 | A1 | 3/2006 | Quigley | |
| 2006/0278294 | A1 | 12/2006 | Quigley | |
| 2009/0205739 | A1 | 8/2009 | Quigley | |
| 2011/0036527 | A1 * | 2/2011 | Ward | D21F 1/0036 162/289 |
| 2013/0098497 | A1 * | 4/2013 | Barrett | D21F 1/0045 139/383 A |
| 2014/0345819 | A1 * | 11/2014 | Heger | D21F 1/0036 162/289 |
| 2018/0142385 | A1 | 5/2018 | Ueda | |
| 2019/0249365 | A1 * | 8/2019 | Ward | D03D 11/00 |

FOREIGN PATENT DOCUMENTS

| | | |
|---|---|---|
| KR | 20130044143 A | 5/2013 |
| KR | 20140082759 A | 7/2014 |
| WO | 99/61698 | 12/1999 |
| WO | 01/02634 | 1/2001 |
| WO | 02/00996 | 1/2002 |
| WO | 02/066733 | 8/2002 |
| WO | 2004/085741 | 10/2004 |
| WO | 2006/096318 | 9/2006 |
| WO | 2009/094101 | 7/2009 |
| WO | 2018/081330 | 5/2018 |

* cited by examiner

MULTI-LAYER WARP BOUND PAPERMAKER'S FORMING FABRICS

RELATED APPLICATION(S)

The present application claims priority from and the benefit of U.S. Provisional Application Ser. No. 62/901,937, filed Sep. 18, 2019, the disclosure of which is hereby incorporated herein in its entirety.

FIELD

The present invention relates generally to papermaking, and more particularly to fabrics employed in papermaking.

BACKGROUND

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run that operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rolls covered with another fabric, typically referred to as a "press felt." Pressure from the rolls removes additional moisture from the web; the moisture removal is enhanced by the presence of a "batt" layer of the press felt. The paper is then transferred to a dryer section for further moisture removal. After drying, the paper is ready for secondary processing and packaging.

As used herein, the terms machine direction ("MD") and cross machine direction ("CMD") refer, respectively, to a direction aligned with the direction of travel of the papermakers' fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the papermaking surface of the fabric is the top of the fabric and the machine side surface of the fabric is the bottom of the fabric.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joining machines are now widely available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling/weft yarns extend in the machine direction. Both weaving methods described hereinabove are well known in the art, and the term "endless belt" as used herein refers to belts made by either method. However, the complexity of the weaves possible with an endless weaving process is limited due to the formation and quality of the fabric at the loom edges.

Effective sheet and fiber support are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paper side fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 8,196,613 to Ward, and an illustrative triple layer fabric is shown in U.S. Pat. No. 7,441,566 to Ward and in U.S. Pat. No. 7,059,357 to Ward.

SUMMARY

In one aspect, the invention is directed to a forming fabric. The forming fabric includes a series of repeat units, each of the repeat units including: a set of binding warp yarns including a first set of binding warp yarns and a second set of binding warp yarns, wherein a binding warp yarn from the first set is paired with a binding warp yarn from the second set; a set of spring warp yarns, wherein each spring warp yarn is arranged between a first pair of binding warp yarns and a second pair of binding warp yarns; a set of top weft yarns including odd and even top weft yarns, wherein the top weft yarns interweave with the binding warp yarns and the spring warp yarns to form a top fabric layer, wherein the spring warp yarns interweave only with the top weft yarns, and wherein a first pair of binding warp yarns is offset to a second pair of binding warp yarns alternately by at least two top weft yarns and then by at least four top weft yarns; a set of bottom weft yarns; and a set of bottom warp yarns, the bottom warp yarns interwoven with the bottom weft yarns to form a bottom fabric layer; wherein the binding warp yarns from the first and second set and the spring warp yarns interweave with the top weft yarns to relatively form a plain weave pattern in defined zones such that (a) the first set of binding warp yarns only pass over odd top weft yarns; (b) the second set of binding warp yarns only pass over even top weft yarns; (c) the first binding warp yarn in the pair is offset from the second binding warp yarn in the pair by at least three top weft yarns to create an overlap in the warp path of the pair of binding warp yarns; and (d) each spring warp yarn passes over even and odd top weft yarns; wherein the binding warp yarns from the first and second set and the bottom warp yarn interweave with the bottom weft yarns.

Another aspect of the invention is directed to a forming fabric. The forming fabric includes a series of repeat units, each of the repeat units including a set of binding warp yarns including a first set of binding warp yarns and a second set of binding warp yarns, wherein a binding warp yarn from the first set is paired with a binding warp yarn from the second set; a set of spring warp yarns, wherein each spring warp yarn is between a first pair of binding warp yarns and a second pair of binding warp yarns; a set of top weft yarns, wherein the top weft yarns interweave with the binding warp yarns and the spring warp yarns to form a top fabric layer, wherein the spring warp yarns interweave only with the top weft yarns, and wherein a first pair of binding warp yarns is offset to a second pair of binding warp yarns alternately by at least two top weft yarns and then by at least four top weft yarns; a set of bottom weft yarns; and a set of bottom warp yarns, the bottom warp yarns interwoven with the bottom weft yarns to form a bottom fabric layer, wherein the binding warp yarns from the first and second set and the bottom warp yarn interweave with the bottom weft yarns such that: (a) each bottom warp yarn forms a plurality of knuckles along the bottom fabric layer; (b) each binding warp yarn from the first set interweaves under a bottom weft yarn beside a bottom warp yarn to form a double knuckle; and (c) each binding warp yarn from the second set interweaves under a bottom weft yarn beside a bottom warp yarn to form a double knuckle.

A further aspect of the invention is directed to a forming fabric. The forming fabric includes a series of repeat units, each of the repeat units including: a set of binding warp yarns including a first set of binding warp yarns and a second set of binding warp yarns, wherein a binding warp yarn from the first set is paired with a binding warp yarn from the second set; a set of spring warp yarns, wherein each spring warp yarn is between a first pair of binding warp yarns and a second pair of binding warp yarns; a set of top weft yarns, wherein the top weft yarns interweave with the binding warp yarns and the spring warp yarns to form a top fabric layer, wherein the spring warp yarns interweave only with the top weft yarns, and wherein a first pair of binding warp yarns is offset to a second pair of binding warp yarns by at least four top weft yarns; a set of bottom weft yarns; and a set of bottom warp yarns, the bottom warp yarns interwoven with the bottom weft yarns to form a bottom fabric layer, wherein the binding warp yarns from the first and second set and the bottom warp yarn interweave with the bottom weft yarns such that: (a) each bottom warp yarn forms a plurality of knuckles along the bottom fabric layer; (b) each binding warp yarn from the first set interweaves under a bottom weft yarn beside a bottom warp yarn to form a double knuckle; and (c) each binding warp yarn from the second set interweaves under a bottom weft yarn beside a bottom warp yarn to form a double knuckle.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
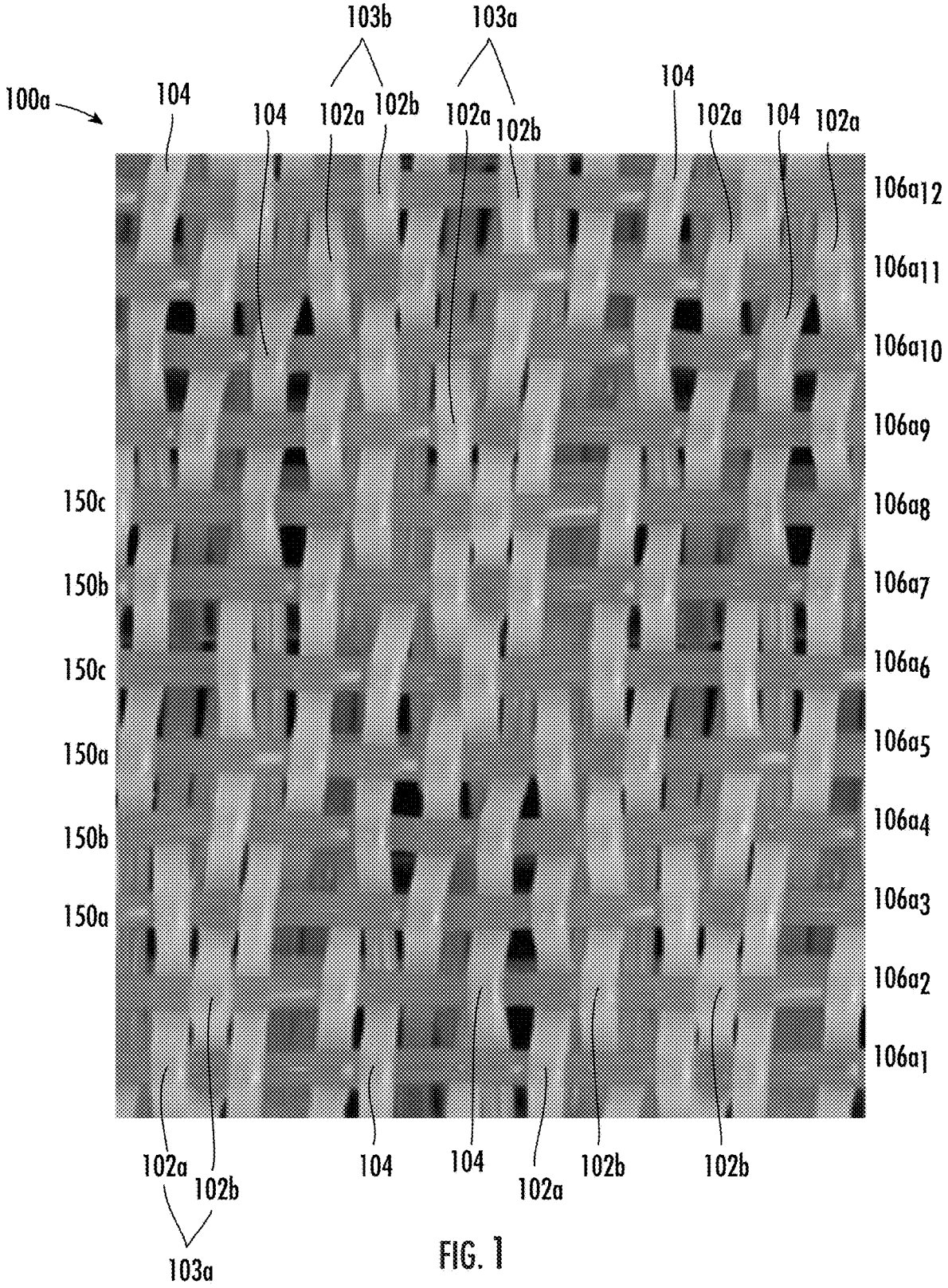
FIG. 1 is a top view of a papermaking forming fabric according to embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention now will be described more fully hereinafter with reference to the accompanying drawings, in which illustrative embodiments of the invention are shown.

As used herein, the terms machine direction ("MD") and cross-machine direction ("CMD") refer, respectively, to a direction aligned with the direction of travel of the forming fabric on the papermaking machine, and a direction parallel to the fabric surface and traverse to the direction of travel. Likewise, directional references to the vertical relationship of the yarns in the fabric (e.g., above, below, top, bottom, beneath, etc.) assume that the paper making surface of the fabric is the top of the fabric and the machine side surface of the fabric is the bottom of the fabric.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper", "top", "middle", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Embodiments of the present invention will now be discussed in greater detail with reference to the drawings. In some cases, two-part reference numerals are used in the drawings. Herein, elements having such two-part reference numerals may be referred to individually by their full reference numeral (e.g., warp yarn 105-2) and may be referred to collectively by the first part of their reference numerals (e.g., the warp yarns 105).

Figure 2:
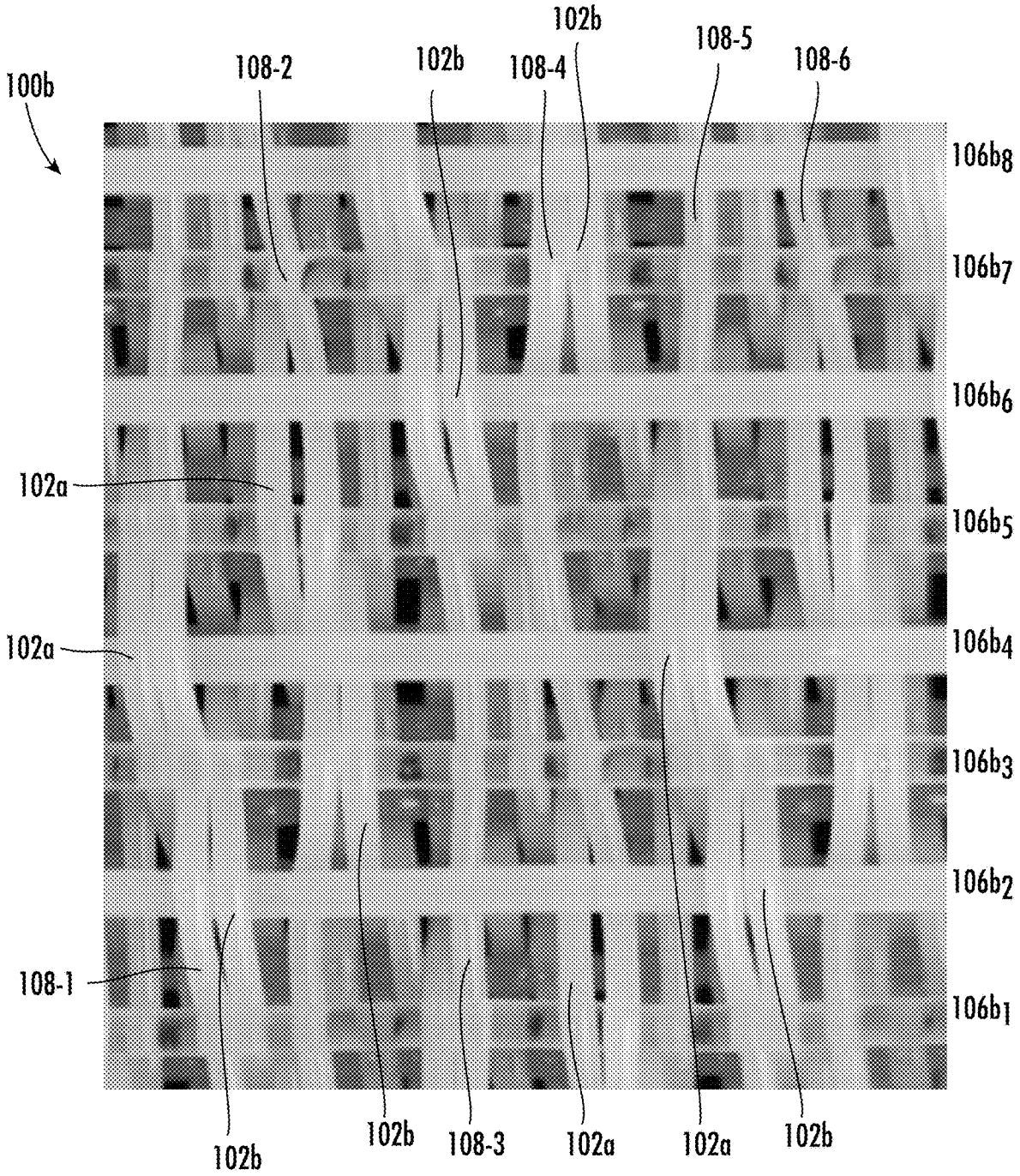
FIG. 2 is a bottom view of a repeat unit of the fabric of FIG. 1.
Figure 3:
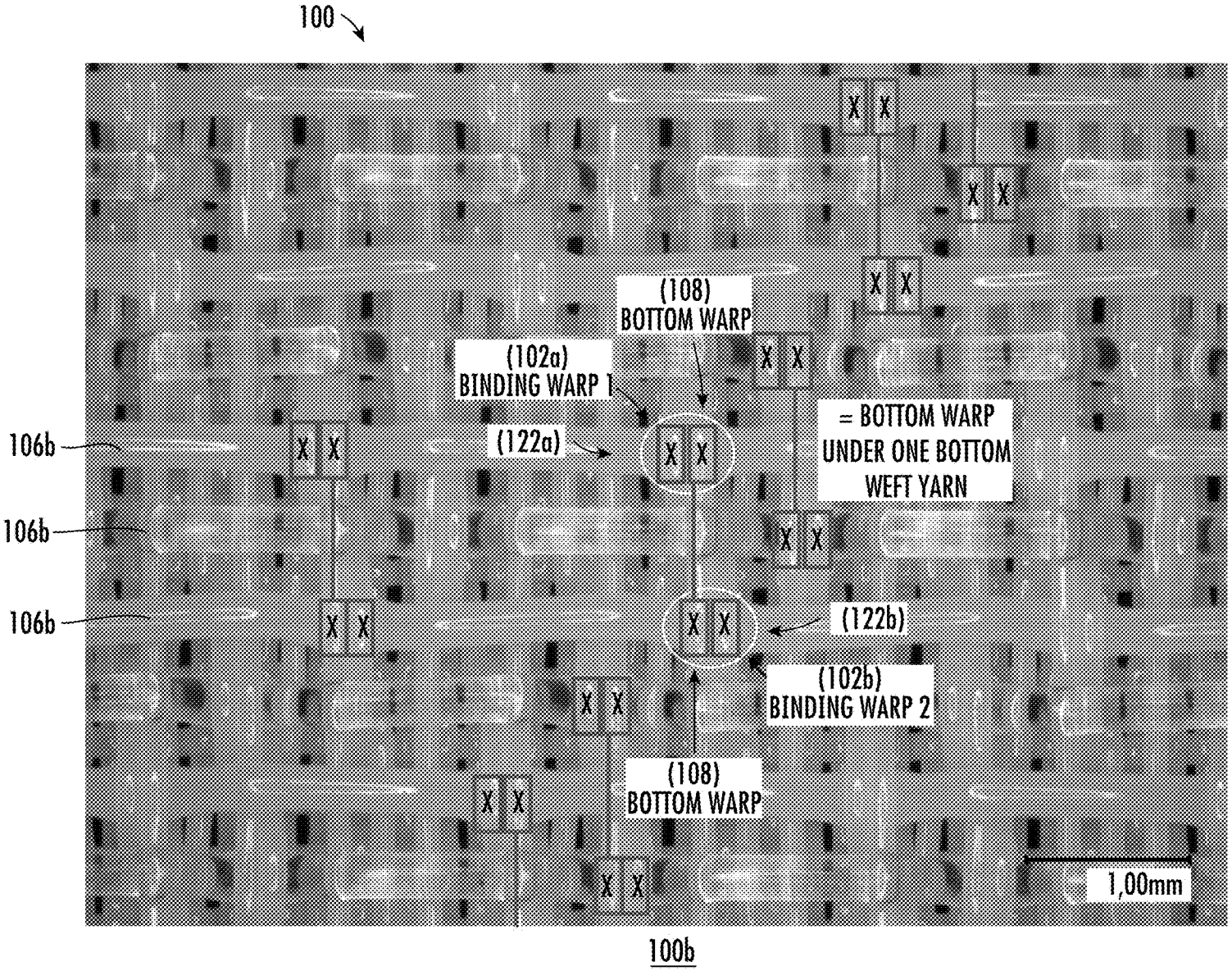
FIG. 3 is a bottom view of the fabric of FIG. 2.

Referring now to the figures, a multi-layer papermaking forming fabric (designated broadly at 100) according to embodiments of the present invention is shown in FIGS. 1-9. FIG. 1 shows the paper side or "top" side 100*a* of the fabric 100. FIG. 2 shows a repeat unit for the machine side or "bottom" side 100*b* of the fabric 100 (i.e., the side facing the papermaking machine). FIG. 3 shows multiple repeat units for the bottom side 100*b* of the fabric 100. Table 1 below provides a legend for FIGS. 3, 6, 7, and 8.

The paper side (top) of the fabric 100 is formed with binding warp yarns, spring warp yarns, and top weft yarns. The top weft yarns and the spring warp yarns interweave only on the paper side of the fabric 100. The machine side (bottom) of the fabric 100 is formed with binding warp yarns, bottom warp yarns, and bottom weft yarns. The bottom weft yarns and the bottom warp yarns interweave only on the machine side of the fabric 100. The binding warp yarns interweave between the paper side and the machine side to bind the two layers of the fabric together to form a multi-layer papermaking forming fabric 100.

A papermaking forming fabric 100 of the present invention may comprise a series of repeat units. As shown in FIGS. 1-3, in some embodiments, each repeat unit may comprise a set of binding warp yarns 102, a set of spring warp yarns 104, a set of top weft yarns 106*a*, a set of bottom weft yarns 106*b*, and a set of bottom warp yarns 108.

In some embodiments, the set of binding warp yarns 102 includes a first set of binding warp yarns 102*a* and a second set of binding warp yarns 102*b*. The binding warp yarns 102*a*, 102*b* run together side-by-side on the paper side of the fabric 100, and are separated by the bottom warp yarns 108 (e.g., 108-1 through 108-6) on the machine side of the fabric 100. The first set of binding warp yarns 102*a* is offset in the warp direction from the second set of binding warp yarns 102*b*. This offset creates an overlap of both sets of binding warp yarns 102*a*, 102*b*. A binding warp yarn from the first set 102*a* is paired with a binding warp yarn from the second set 102*b*, creating a binding warp pair 103.

In some embodiments, the binding warp yarns 102*a*, 102*b* of each binding warp pair 103 run adjacent to each other in the top fabric layer 100*a* and may be separated by one bottom warp yarn 108 in the bottom fabric layer 100*b*. In some embodiments, the first pair of binding warp yarns 103*a* is offset from the second pair of binding warp yarns 103*b* alternately by at least two top weft yarns 106*a* and then by at least four top weft yarns 106*a*. A spring warp yarn 104 is located between a first pair 103*a* of binding warp yarns 102*a*, 102*b* and a second pair 103*b* of binding warp yarns 102*a*, 102*b*. The top weft yarns 106*a* (e.g., $\mathbf{106}a_{1\text{-}12}$) interweave with the binding warp yarns 102*a*, 102*b* and the spring warp yarns 104 to form the top fabric layer 100*a* (i.e., the paper side of the fabric 100). The number of top weft yarns 106*a* per repeat unit may vary. In some embodiments, the top fabric layer 100*a* may comprise 12 top weft yarns 106*a* per repeat unit (i.e., top weft yarns $\mathbf{106}a_{1\text{-}12}$), for example, when the forming fabric 100 has a weft yarn ratio of 3:2. In other embodiments, the top fabric layer 100*a* may comprise 16 top weft yarns 106*a* per repeat unit (i.e., top weft yarns 106$a_{1\text{-}16}$), for example, when the forming fabric 100 has a weft yarn ratio of 2:1. In some embodiments, the first pair of binding warp yarns 103*a* is offset to the second pair of binding warp yarns 103*b* by at least four top weft yarns 106*a*. The bottom weft yarns 106*b* (e.g., 106$b_{1\text{-}8}$) interweave with the bottom warp yarns 108 to form the bottom fabric layer 100*b* (i.e., the machine side of the fabric 100).

In some embodiments, the binding warp yarns 102*a*, 102*b* of the first and second set and the spring warp yarns 104 interweave with the top weft yarns 106*a* to relatively form a "over 1/under 1" pattern of a plain weave in defined zones on the paper side of the fabric 100. In some embodiments, the plain weave in defined zones is formed such that (a) the first set of binding warp yarns 102*a* only pass over "odd-numbered" top weft yarns 106*a* (e.g., 106$a_1$, 106$a_3$, 106$a_5$, 106$a_7$, 106$a_9$, 106$a_{11}$), (b) the second set of binding warp yarns 102*b* only pass over "even-numbered" top weft yarns 106*a* (e.g., 106$a_2$, 106$a_4$, 106$a_6$, 106$a_8$, 106$a_{10}$, 106$a_{12}$), and (c) the first binding warp yarns 102*a* in a pair 103 of binding warp yarns 102*a*, 102*b* is offset from the second binding warp yarn 102*b* in the pair 103 by at least three top weft yarns 106*a*. This offset creates an overlap in the warp path of the pair 103 of binding warp yarns 102*a*, 102*b*.

FIGS. 4A-4D illustrate cross-sectional views of exemplary weave patterns that may be used to form the top and bottom fabric layers 100*a*, 100*b* of a papermaking forming fabric 100 according to embodiments of the present invention. As shown in FIGS. 4A-4D, the warp yarns (i.e., binding warp yarns 102*a*, 102*b*, spring warp yarns 104, and bottom warp yarns 108) may include segments that interweave with the weft yarns (106*a*, 106*b*) in a specific "over/under" sequence.

Figure 4A:
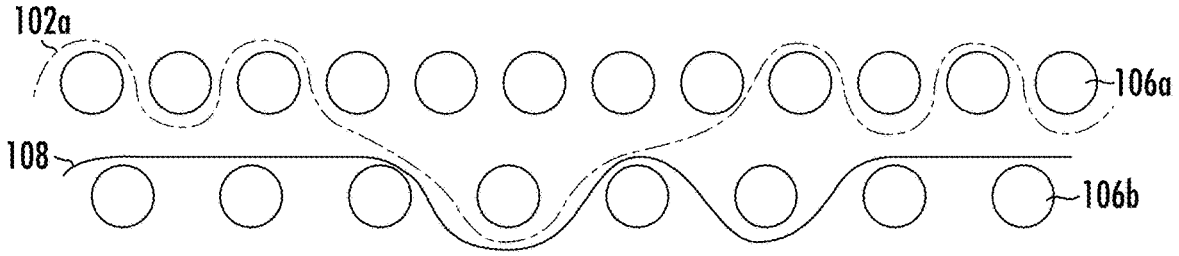
FIG. 4A is a cross-sectional view of the fabric of FIG. 1 illustrating an exemplary weave pattern for a first binding warp yarn.
Figure 4B:
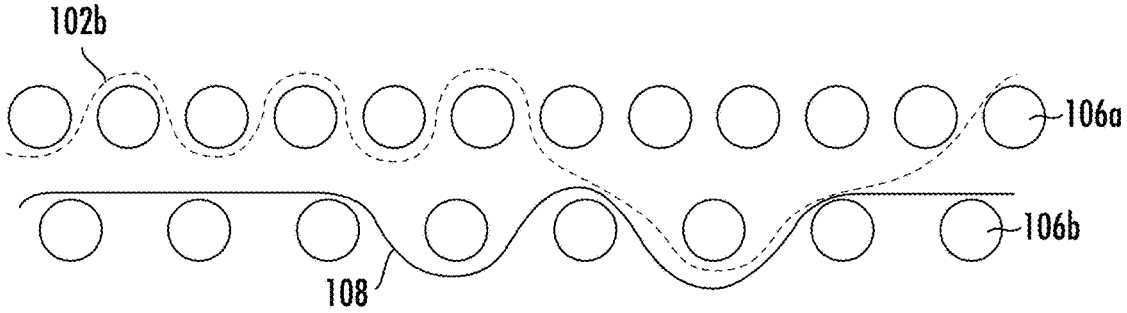
FIG. 4B is a cross-sectional view of the fabric of FIG. 1 illustrating an exemplary weave pattern for a second binding warp yarn.
Figure 4C:
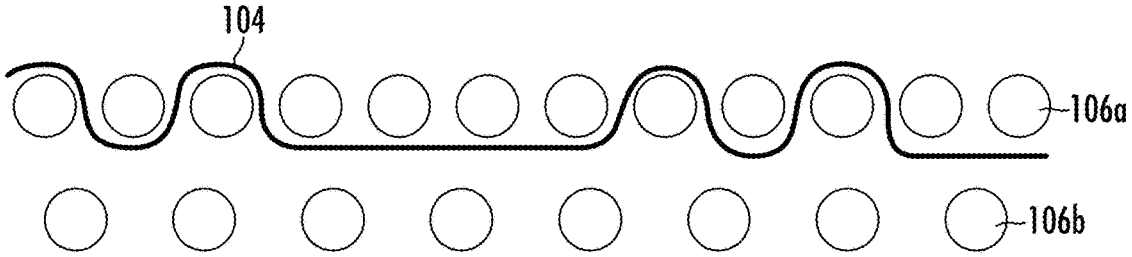
FIG. 4C is a cross-sectional view of the fabric of FIG. 1 illustrating an exemplary weave pattern for a spring warp yarn.
Figure 4D:
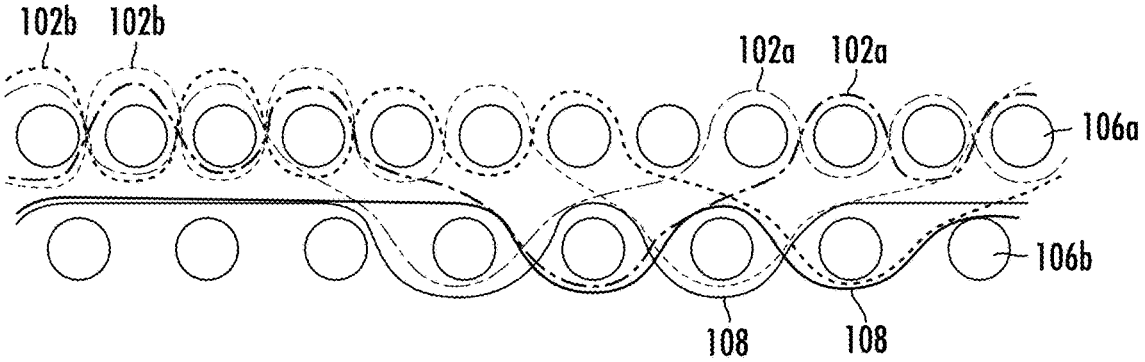
FIG. 4D is a cross-sectional view of the fabric of FIG. 1 illustrating an exemplary weave pattern of adjacent pairs of binding warp yarns.

For example, as shown in FIGS. 4A, 4B and 4D, in some embodiments, each bottom warp yarn 108 may include a segment in which the bottom warp yarn 108 interweaves with the bottom weft yarn 106*b* in an under 1/over 1/under 1 sequence. In some embodiments, each binding warp yarn from the first and second set 102*a*, 102*b* may include a segment in which each binding warp yarn 102*a*, 102*b* interweaves with the top weft yarns 106*a* in an over 1/under 1/over 1/under 5/over 1/under 1/over 1/under 1 sequence (FIG. 4A) (e.g., in a fabric 100 having a weft yarn ratio of 3:2). In some embodiments, each binding warp yarn from the first and second set 102*a*, 102*b* may include a segment in which each binding warp yarn 102*a*, 102*b* interweaves with the top weft yarns 106 in an over 1/under 1/over 1/under 1/over 1/under 7/over 1/under 1/over 1/under 1 sequence (e.g., in a fabric 100 having a weft yarn ratio of 2:1). As shown in FIG. 4C, in some embodiments, each spring warp yarn 104 may include a segment in which the spring warp yarn 104 interweaves with the top weft yarns 106*a* in an over 1/under 1/over 1/under 4/over 1/under 1/over 1/under 2 sequence (e.g., in a fabric 100 having a weft yarn ratio of 3:2). In some embodiments, each spring warp yarn 104 may include a segment in which the spring warp yarn 104 interweaves with the top weft yarns 106*a* in an over 1/under 2/over 1/under 1/over 1/under 1/over 1/under 4/over 1/under 1/over 1/under 1 sequence (e.g., in a fabric 100 having a weft yarn ratio of 2:1).

Figure 5A:
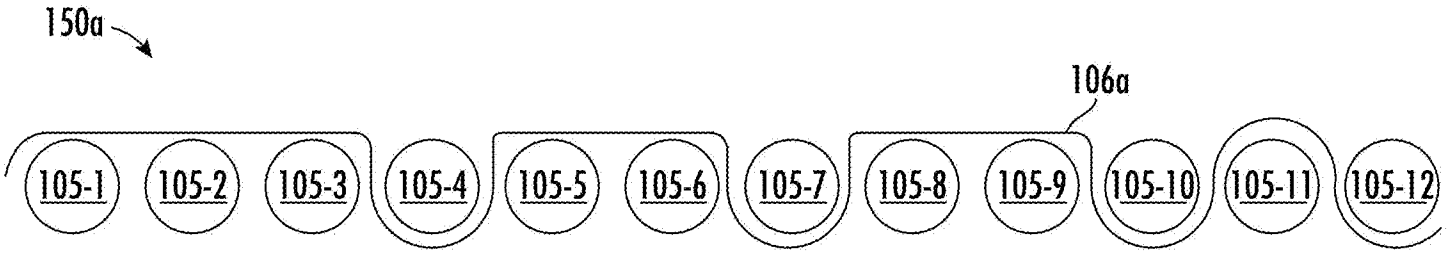
FIG. 5A is a cross-sectional view of the fabric of FIG. 1 illustrating an exemplary weave pattern for a top weft yarn.
Figure 5B:
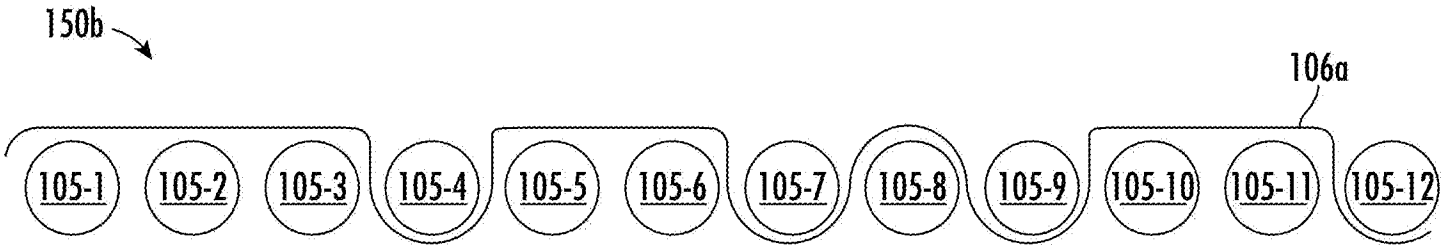
FIG. 5B is a cross-sectional view of the fabric of FIG. 1 illustrating an exemplary weave pattern for a top weft yarn.
Figure 5C:
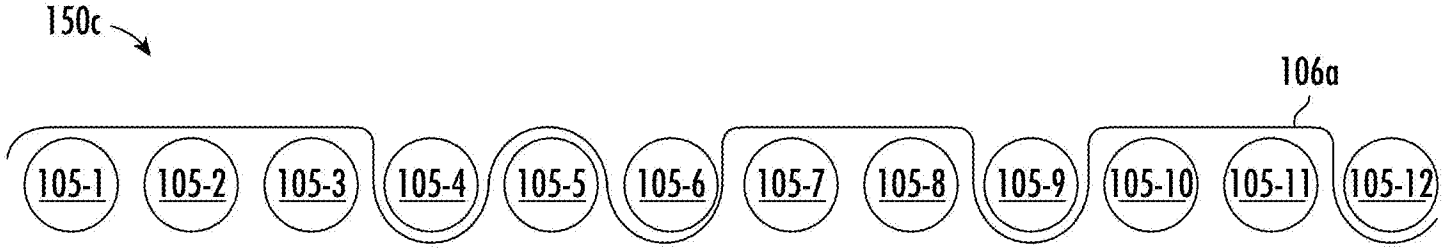
FIG. 5C is a cross-sectional view of the fabric of FIG. 1 illustrating an exemplary weave pattern for a top weft yarn.

Referring to FIGS. 5A-5C, in some embodiments, the top fabric layer 100*a* may comprise a series of weft path repeat units 150. The weft path repeat units 150 may comprise at least one first weft path 150*a* (e.g., FIG. 5A), at least one second weft path 150*b* (e.g., FIG. 5B), and at least one third weft path 150*c* (e.g., FIG. 5C). FIGS. 5A-5C illustrate exemplary weave patterns for a top weft yarn 106*a* with the warp yarns 105 (i.e., binding warp yarns 102*a*, 102*b* and spring warp yarns 104) in the top fabric layer 100*a*. For example, as shown in FIG. 5A, in some embodiments, the first weft path 150*a* may include a segment in which a top weft yarn 106*a* interweaves with the warp yarns 105 (e.g., 105-1 through 105-12) in an over 3/under 1/over 2/under 1/over 2/under 1/over 1/under 1 sequence. As shown in FIG. 5B, in some embodiments, the second weft path 150*b* may include a segment in which a top weft yarn 106*a* interweaves with the warp yarns 105 in an over 3/under 1/over 2/under 1/over 1/under 1/over 2/under 1 sequence. As shown in FIG. 5C, in some embodiments, the third weft path 150*c* may include a segment in which a top weft yarn 106*a* interweaves with the warp yarns 105 in an over 3/under 1/over 1/under 1/over 2/under 1/over 2/under 1 sequence.

The spring warp yarns 104 only interweave with the top weft yarns 106*a*. In some embodiments, each spring warp yarn 104 passes over "even" and "odd" top weft yarns 106*a*. In some embodiments, each spring warp yarn 104 may include a segment in which the spring warp yarn 104 swings toward a first pair 103*a* of binding warp yarns 102*a*, 102*b* to push the first pair 103*a* of binding warp yarns 102*a*, 102*b* together. Each spring warp yarn 104 may further include a segment in which the spring warp yarn 104 swings toward a second adjacent pair 103*b* of binding warp yarns 102*a*, 102*b* to push the second pair 103*b* of binding warp yarns 102*a*, 102*b* together (see, e.g., FIG. 1). Thus, each binding warp pair 103*a*, 103*b* is supported by one spring warp yarn 104 on the left side and supported by a different spring warp yarn 104 on the right side.

Figure 8:
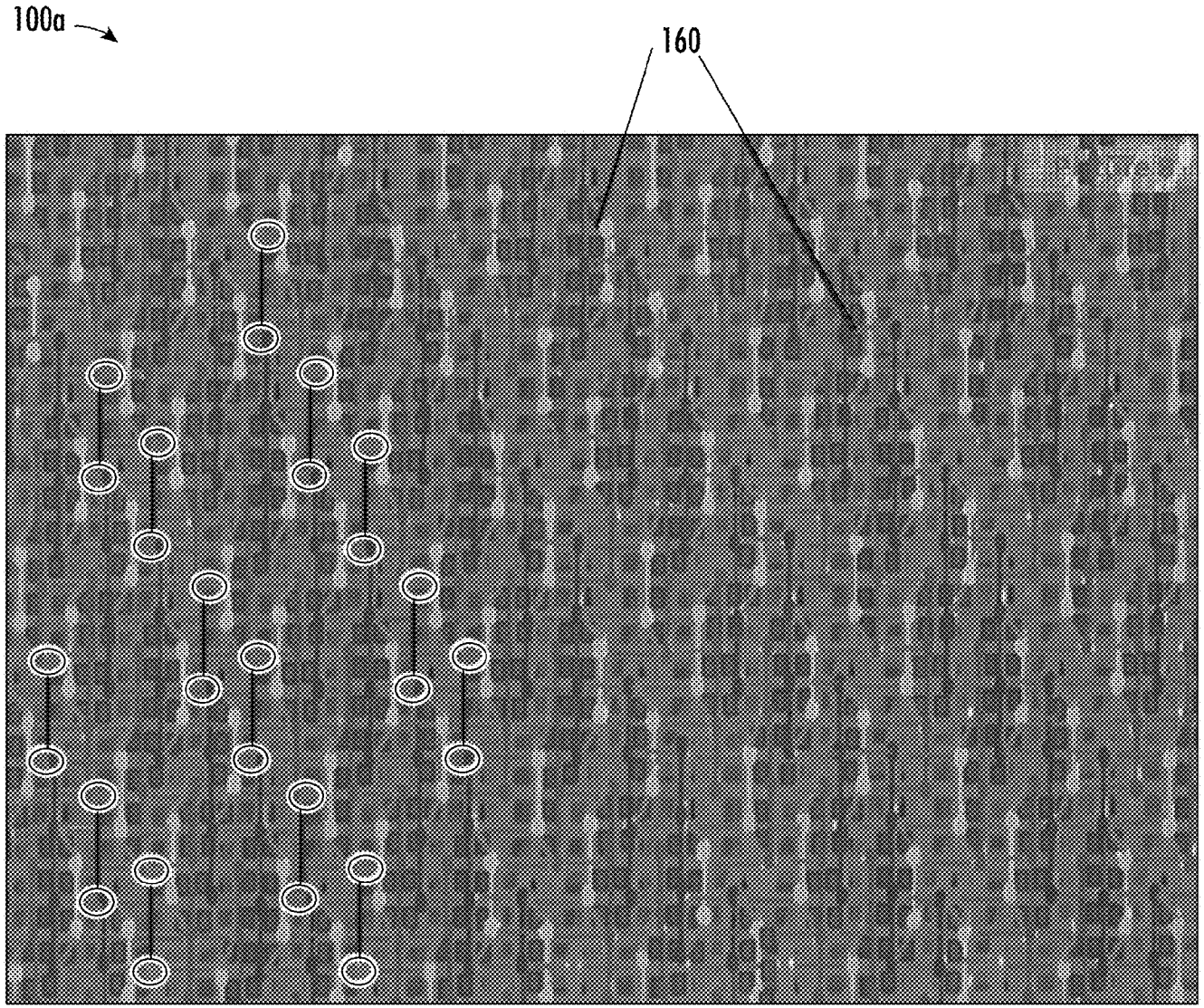
FIG. 8 is a top view of the fabric of FIG. 1 illustrating the paisley pattern shaped plain weave zones and the zones around formed in the top fabric layer.

The binding warp pairs 103*a*, 103*b* in combination with one spring warp yarn 104 on the left side and one spring warp yarn 104 on the right side create a "paisley pattern" shaped plain weave zone 160 (see, e.g., FIG. 8). These paisley pattern shaped plain weave zones 160 formed in the top fabric layer 100*a* are discussed in further detail below.

In some embodiments, the forming fabric 100 of the present invention has a weft yarn ratio of three top weft yarns 106*a* to two bottom weft yarns 106*b* (i.e., 3:2) (see, e.g., FIGS. 1-8). In some embodiments, the forming fabric 100 of the present invention has a weft yarn ratio of two top weft yarns 106*a* to one bottom weft yarn 106*b* (i.e., 2:1) (see, e.g., FIG. 9).

Figure 6:
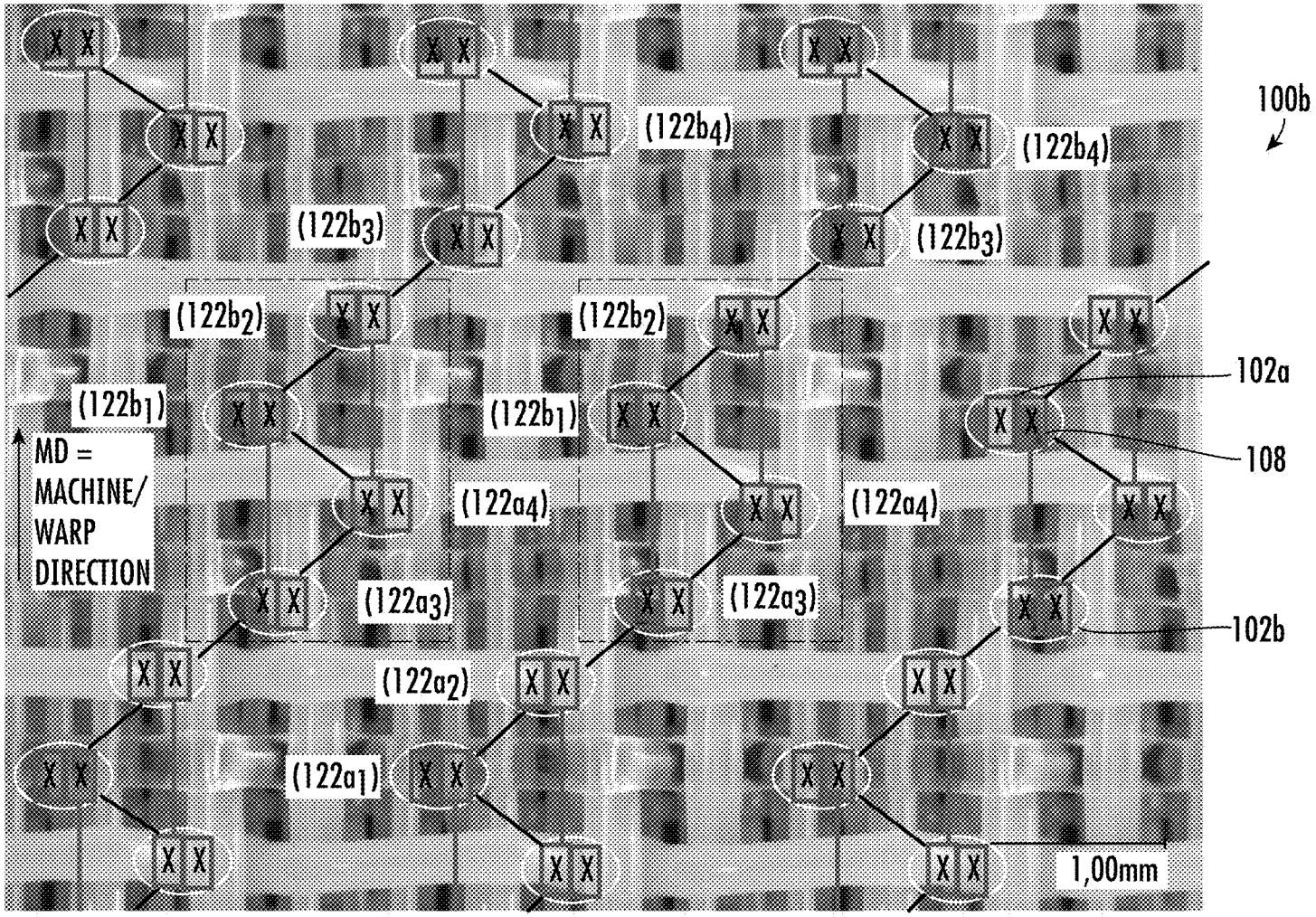
FIG. 6 is a bottom view of the fabric of FIG. 1 illustrating an exemplary zigzag pattern of double knuckles formed in the bottom fabric layer according to embodiments of the present invention.
Figure 7:
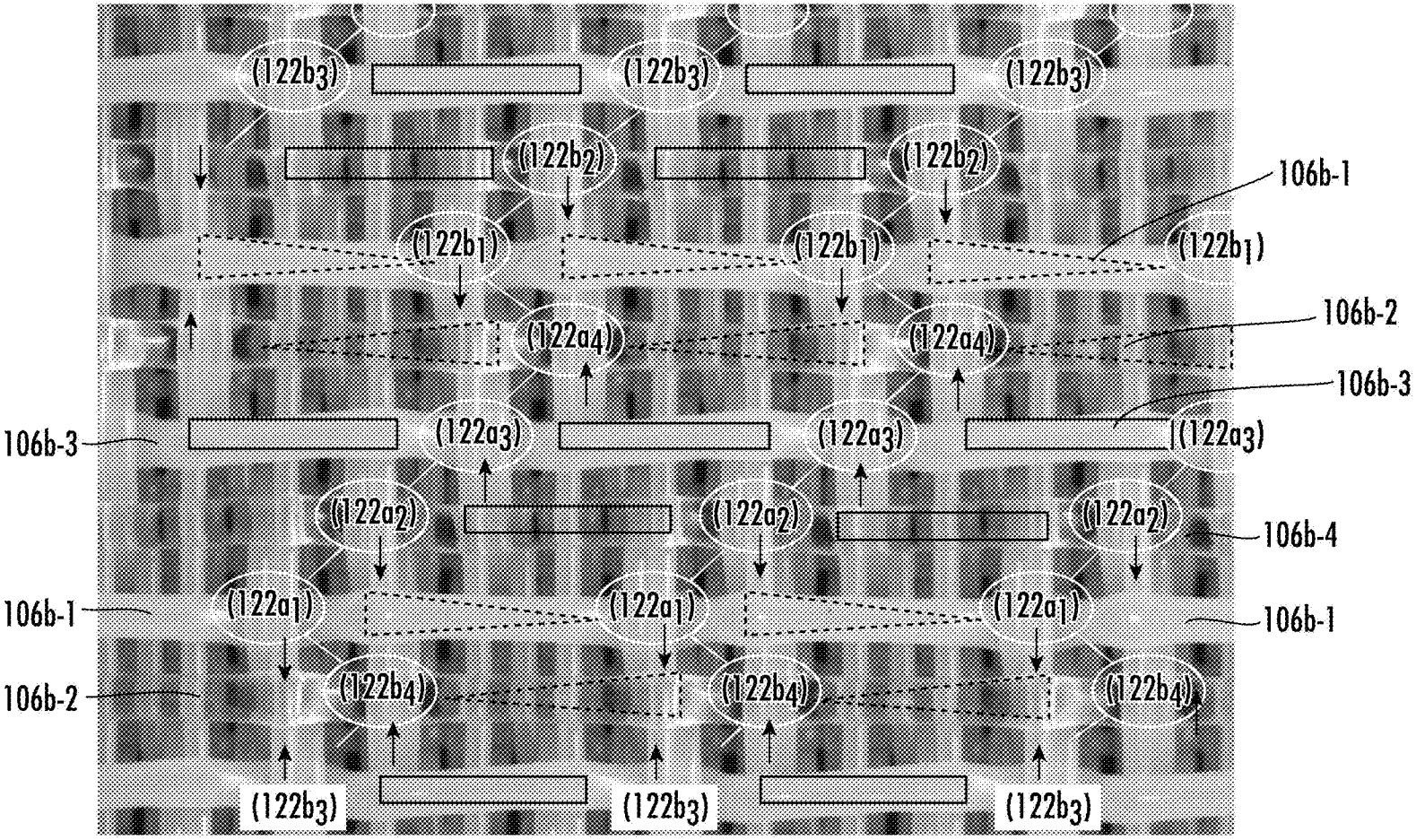
FIG. 7 is a bottom view of the fabric of FIG. 1 illustrating exemplary floats (symmetrical/asymmetrical) of the bottom weft yarns according to embodiments of the present invention.

As shown in FIG. 3, in some embodiments, the binding warp yarns from the first and second set 102*a*, 102*b* and the bottom warp yarns 108 interweave with the bottom weft yarns 106*b* such that (a) each bottom warp yarn 108 forms a plurality of knuckles 122 along the bottom fabric layer 100*b*, (b) each binding warp yarns from the first set 102*a* interweaves under a bottom weft yarn 106*b* beside a bottom warp yarn 108 to form a first double knuckle 122, and (c) each binding warp yarns from the second set 102*b* interweaves under a not adjacent bottom weft yarn 106*b* as the first binding warp yarn 102*a* or a bottom weft yarn 106*b* beside a bottom warp yarn 108 to form a second double knuckle 122 (see also, e.g., FIGS. 6-7). As used herein, "double knuckle" refers to when two adjacent warp yarns (e.g., a binding warp yarn 102*a*, 102*b* and a bottom warp yarn 108) bind side-by-side under the same bottom weft yarn 106*b*. In the figures, the double knuckles 122 or their positions are highlighted by a white oval (see also, e.g., Table 1).

In some embodiments, at least one bottom weft yarn 106*b* separates a first double knuckle 122 formed by a bottom warp yarn 108 and a binding warp yarn from the first set 102*a* and a second double knuckle 122 formed by the same bottom warp yarn 108 and a binding warp yarn from the second set 102*b* (e.g., in a fabric 100 having a weft yarn ratio of 3:2). This short float of the bottom warp yarn 108 under at least one bottom weft yarn 106*b* and the arrangement of the double knuckles 122 may also provide an additional advantage of fixation of the bottom weft yarns 106*b*, thereby helping to mitigate or eliminate movement of the bottom weft yarns 106*b*. In some embodiments, these two double knuckles may be separated by two bottom weft yarns 106*b*.

Referring now to FIG. 6, in some embodiments, the bottom warp yarn 108 forming part of the first double knuckle 122$b_1$ also forms part of the third double knuckle 122$a_3$ and the adjacent bottom warp yarn 108 forming part of the second double knuckle 122$b_2$ also forms part of the fourth double knuckle 122$a_4$. This arrangement of double knuckles 122 in the machine direction (i.e., two double knuckles 122 behind each other, with at least one bottom weft yarn between, may provide additional stability of bending stiffness in this area of four double knuckles 122 (i.e., the boxed areas in FIG. 6).

As shown in FIG. 6, in some embodiments, the arrangement of double knuckles 122 formed along the bottom fabric layer 100*b* may follow a sort of a zigzag pattern. In some embodiments, the zigzag pattern may comprise a first set of double knuckles 122$a_{1\text{-}4}$ formed in a first diagonal line and a second set of double knuckles 122$b_{1\text{-}4}$ formed in a second diagonal line, and the second diagonal line 122*b* of double knuckles is offset from the first diagonal line of double knuckles 122*a*. The arrangement of double knuckles 122*a*, 122*b* in a zigzag diagonal pattern on the machine side of the fabric 100 may provide the fabric 100 of the present invention with more stability in the diagonal direction (i.e., the cross machine direction). In addition, this arrangement of double knuckles 122*a*, 122*b* may help to prevent the fabric 100 from drifting on the papermaking machine.

Referring now to FIG. 7, in some embodiments, the bottom weft yarns 106*b*-1 may provide additional support for a balanced running direction. The short float of the bottom warp yarn 108 under only one bottom weft yarn 106*b* (see also, e.g., FIG. 3) pushes the bottom weft yarn 106*b* (106*b*-1 and 106*b*-2) outwards, creating an asymmetrical form of the bottom weft yarn float. This asymmetrical form of the bottom weft yarn float may create a broader contact area on running side, moved to one side of the bottom yarn float. The abrasion ellipse of this bottom yarn float will also be asymmetrical (marked on the bottom yarn floats with a triangle in FIG. 7).

With the arrangement of the offset of the double knuckles diagonals, two different asymmetrical bottom weft yarn floats were arranged adjacent at the end/beginning of the double knuckle diagonals, alternating in different directions, which will balance their asymmetry. The asymmetry of bottom yarn float 106*b*-1 will be balanced by bottom weft yarn 106*b*-2, having an opposite asymmetrical form of the bottom weft yarn float. The other bottom weft yarns 106*b*-3 and 106*b*-4 weaving under the double knuckles in the middle of the diagonals bind in a way with the warp yarns creating a symmetrical bottom weft yarn float (marked on the bottom yarn floats with a rectangle in FIG. 7). In other embodiments bottom weft yarns 106*b* may have only asymmetrical bottom weft yarn floats, arranged alternately in succession (weft yarn ratio of 2:1).

For example, as shown in FIG. 7, in some embodiments, a portion of the float of the bottom weft yarns 106*b* to the right of the first double knuckle 122$b_1$ and 122$a_1$ has a larger contact area than a portion of the same bottom weft yarn 106*b* to the left of the first double knuckle 122$b_1$ and 122$a_1$. In some embodiments, the portion of the bottom weft yarns 106*b* to the left of the fourth double knuckle 122$a_4$ and 122$b_4$ has a larger contact area than a portion of the same bottom weft yarn 106*b* to the right of the fourth double knuckle 122$a_4$ and 122$b_4$. In some embodiment, portions of the float of the bottom weft yarns 106*b* to the left and right of the second and third double knuckles 122$a_2$, 122$a_3$, 122$b_2$, 122$b_3$ in the diagonal have equal contact areas. Thus, as shown in FIG. 7, in some embodiments, the bottom weft yarns 106*b* are arranged such that two bottom weft yarns 106*b* having symmetrical floats (i.e., the "rectangles") followed by two bottom weft yarns 106*b* having an asymmetrical floats (i.e., the "triangles") in opposite directions. Alternating the directions of the asymmetrical bottom weft yarn floats, in some embodiments mixed with symmetrical bottom weft floats helps to counteract drifting problems.

Referring to FIG. 8, representing multiple repeat units of the paper side as seen in FIG. 1, to show the effect of the arrangement of the different weft path (FIG. 5A-C). In some embodiments, the weft path repeat unit 150 may include a segment of weft paths 150*a-c* (FIG. 5A-C) arranged as follows: the first weft path 150*a*, the second weft path 150*b*, the first weft path 150*a*, the third weft path 150*c*, the second weft path 150*b*, and the third weft path 150*c*. In some embodiments, the weft path repeat unit 150 may include a segment of weft paths 150*a-c* arranged as follows: the first weft path 150*a*, the third weft path 150*c*, the second weft path 105*b*, and the second weft path 150*b*. It will be understood that the weft path repeat unit 150 may vary depending on the weft ratio of the fabric 100. The weft path repeat units 150 may create a special structure on the top fabric layer 100*a*.

A part of this structure is formed by the arrangement of the top weft yarn 106*a* float length over two binding paper side warp yarns 102*a*, 102*b* that occurs in weft paths 150*a-c*. The arrangement of the float over two paper side warp yarns are placed between paisley pattern shaped plain weave zones. This arrangement creates additional transverse stability and a compensation of the skew in the cross machine direction. In some embodiments, the areas between the paisley pattern zones are smaller than and run opposite to the first and second diagonal lines of the double knuckles 122 on the bottom fabric layer 100*b*. In some embodiments, the weft path repeat units 150 create a top fabric layer 100*a* without visible diagonal lines.

Another part of this structure are the segments of the first, second, and third weft paths 150*a-c* that passes over 3 warp yarns in the top fabric layer 100*a* aligned in the middle between first and third double knuckles (e.g., 122$b_1$ and 122$a_3$) respectively the second and fourth double knuckles (e.g., 122$b_2$ and 122$a_4$) and in the drift of the diagonals of double knuckles 122 formed on the bottom fabric layer 100*b*. This alignment of a longer top weft yarn 106*a* float over 3 (or more) warp yarns helps to counteract material compaction seen in prior art fabrics which often results in a dewatering disturbance and marking in the paper.

In some embodiments, the segments of the first, second, and third weft paths 150*a-c* that passes over 1 warp yarn create the center of the paisley pattern shaped plain weave zones 160 in the top fabric layer 100*a*. Consecutive weft path repeat units 150 create mirrored paisley pattern shaped plain weave zones 160 in the top fabric layer 100*a*. As shown in FIG. 8, the paisley pattern shaped plain weave zones 160 formed in the top fabric layer 100*a* are aligned between the diagonals (zigzag pattern) of double knuckles 122 on the bottom fabric layer 100*b*.

The arrangement of the stitches of the fabric in these paisley pattern shaped zones 160 and the reduction of the mesh size in the top fabric layer 100*a* allows for an optimum on fiber supporting points. The meshes also provide a supporting zone for short fibers in the papermaking machine. In addition, the reduced size of the meshes creates a smaller drainage channel which helps to create a higher flow rate of aqueous medium during the papermaking process. Forming fabrics 100 of the present invention can be more closed on the paper side of the fabric and have at the same time a very high flow velocity.

Figure 9:
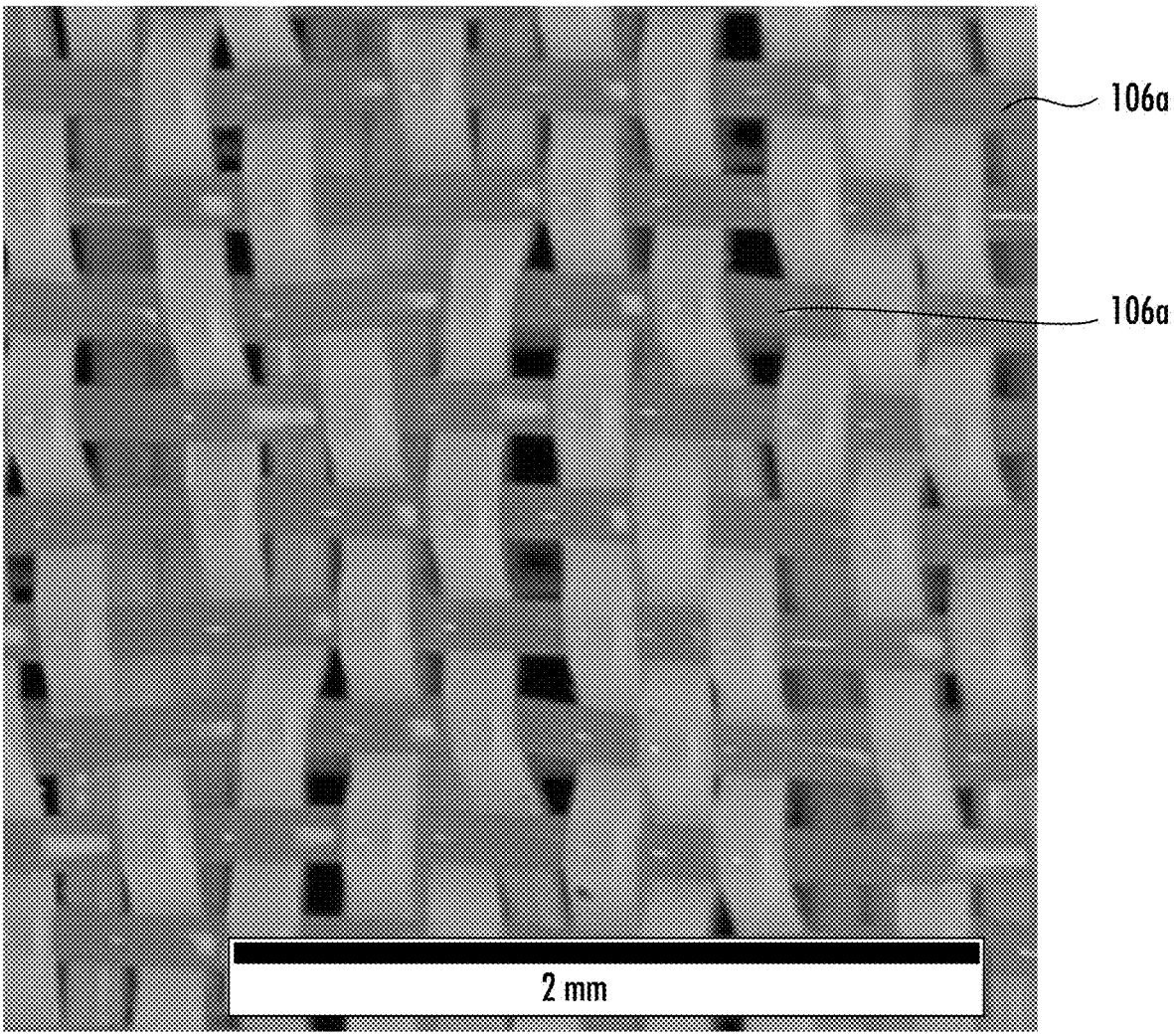
FIG. 9 is a top view of a papermaking forming fabric according to different embodiments of the present invention.

As discussed above, forming fabrics 100 of the present invention may comprise different weft yarn ratios. FIG. 9 shows a forming fabric 100' according to embodiments of the present invention having a 2:1 weft yarn ratio (i.e., two top weft yarns 106*a*' to one bottom weft yarn 106*b*'). Other weft yarn ratios may be incorporated into a forming fabric 100 of the present invention. For example, in some embodiments, a forming fabric 100 may have a weft yarn ratio of 1:1, 3:1, or 5:2.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

TABLE 1

| Legend for FIGS. 3, 6, 7, and 8 |
|---|
| = Bottom warp under one bottom weft yarn |
| = Binding point between warp and weft/binding of the bottom warp over the bottom weft yarn |
| = Binding point between warp and weft/binding of the binding warp 1 over the bottom weft yarn |
| = Binding point between warp and weft/binding of the binding warp 2 over the bottom weft yarn |
| = double binding point of two warps under one bottom weft yarn (bottom warp under a bottom weft yarn and one binding warp under the same bottom weft yarn). |
| = floating of the paper side weft yarn over 3 warp (one paper side warp and two binding warp) |
| = floating of the paper side weft yarn over 2 warps on paper side |
| = Binding point between binding warp 2 and a paper side weft yarn<br>= Binding warp 2 under one paper side weft yarn |
| = Binding point between binding warp 1 and a paper side weft yarn<br>= Binding warp 1 under one paper side weft yarn |
| = Binding point between paper side warp spring warp and a paper side weft yarn<br>= spring warp 1 under one or more paper side weft yarn |
| = "Paisley" area with small meshes on paper side with plain weave only in this area (looks like paisley) |

That which is claimed is:

1. A forming fabric comprising a series of repeat units, each of the repeat units comprising:

a set of binding warp yarns including a first set of binding warp yarns and a second set of binding warp yarns, wherein a binding warp yarn from the first set is paired with a binding warp yarn from the second set;

a set of spring warp yarns, wherein each spring warp yarn is arranged between a first pair of binding warp yarns and a second pair of binding warp yarns;

a set of top weft yarns including odd and even top weft yarns, wherein the top weft yarns interweave with the binding warp yarns and the spring warp yarns to form a top fabric layer, wherein the spring warp yarns interweave only with the top weft yarns, and wherein a first pair of binding warp yarns is offset to a second pair of binding warp yarns alternately by at least two top weft yarns and then by at least four top weft yarns;

a set of bottom weft yarns; and a set of bottom warp yarns, the bottom warp yarns interwoven with the bottom weft yarns to form a bottom fabric layer;

wherein the binding warp yarns from the first and second set and the spring warp yarns interweave with the top weft yarns to relatively form a plain weave pattern in defined zones such that (a) the first set of binding warp yarns only pass over odd top weft yarns; (b) the second set of binding warp yarns only pass over even top weft yarns; (c) the first binding warp yarn in the pair is offset from the second binding warp yarn in the pair by at least three top weft yarns to create an overlap in the warp path of the pair of binding warp yarns; and (d) each spring warp yarn passes over even and odd top weft yarns;

wherein the binding warp yarns from the first and second set and the bottom warp yarn interweave with the bottom weft yarns, wherein the binding warp yarns from the first and second set and the bottom warp yarn interweave with the bottom weft yarns such that: (a) each bottom warp yarn forms a plurality of knuckles along the bottom fabric layer; (b) each binding warp yarn from the first set interweaves under a bottom weft yarn beside a bottom warp yarn to form a respective first knuckle of the plurality of knuckles; and (c) each binding warp yarn from the second set interweaves under a bottom weft yarn beside a bottom warp yarn to form a respective second knuckle of the plurality of knuckles such that adjacent first and second knuckles form a plurality of double knuckles along the bottom fabric layer.

2. The forming fabric of claim 1, wherein each spring warp yarn includes a segment in which the spring warp yarn interweaves with the top weft yarns in an over 1/under 1/over 1/under 4/over 1/under 1/over 1/under 2 sequence.

3. The forming fabric of claim 1, wherein each spring warp yarn includes a segment in which the spring warp yarn swings toward a first pair of binding warp yarns to push the first pair of binding warp yarns together and a segment in which the spring warp yarn swings toward a second adjacent pair of binding warp yarns to push the second pair of binding warp yarns together.

4. The forming fabric of claim 1, wherein each binding warp yarns from the first and second set includes a segment in which each binding warp yarn interweaves with the top weft yarns in an over 1/under 1/over 1/under 5/over 1/under 1/over 1/under 1 sequence.

5. The forming fabric of claim 1, wherein the repeat units of the top fabric layer comprises 4 binding warp yarns from the first set, 4 binding warp yarns from the second set, 4 spring warp yarns, and 12 top weft yarns, and wherein the repeat units of the bottom fabric layer comprises 4 bottom warp yarns, 8 binding warp yarns, and 8 bottom weft yarns.

6. The forming fabric of claim 1, wherein an arrangement of double knuckles along the bottom fabric layer follows a zigzag pattern.

7. The forming fabric of claim 6, wherein the zigzag pattern comprises a first set of double knuckles formed in a first diagonal line and a second set of double knuckles formed in a second diagonal line, each set of double knuckles comprising four double knuckles, the second diagonal line of double knuckles being offset from the first diagonal line of double knuckles.

8. The forming fabric of claim 7, wherein each diagonal line comprises 4 double knuckles, each double knuckle formed by a bottom warp yarn and a binding warp yarn from the first or second set.

9. The forming fabric of claim 6, wherein the bottom warp yarn forming part of the first double knuckle in the second diagonal line forms part of the third double knuckle in the first diagonal line, and the bottom warp yarn forming part of the second double knuckle in the second diagonal line forms part of the fourth double knuckle in the first diagonal line.

10. The forming fabric of claim 1, wherein the top fabric layer comprises a series of weft path repeat units comprising at least one first weft path, at least one second weft path, and at least one third weft path, wherein (a) the first weft path includes a segment in which a top weft yarn interweaves with the binding and spring warp yarns in an over 3/under 1/over 2/under 1/over 2/under 1/over 1/under 1 sequence;

(b) the second weft path includes a segment in which a top weft yarn interweaves with the binding and spring warp yarns in an over 3/under 1/over 2/under 1/over 1/under 1/over 2/under 1 sequence; and (c) the third weft path includes a segment in which a top weft yarn interweaves with the binding and spring warp yarns in an over 3/under 1/over 1/under 1/over 2/under 1/over 2/under 1 sequence.

11. The forming fabric of claim 10, wherein the weft path repeat unit includes a segment of weft paths arranged as follows: the first weft path, the second weft path, the first weft path, the third weft path, the second weft path, and the third weft path.

12. The forming fabric of claim 10, wherein the weft path repeat units create a top fabric layer that is devoid of visible diagonal lines.

13. The forming fabric of claim 10, wherein the weft path repeat unit creates a paisley pattern shaped plain weave zone in the top fabric layer.

14. The forming fabric of claim 10, wherein consecutive weft path repeat units create mirrored paisley pattern shaped plain weave zone in the top fabric layer.

15. The forming fabric of claim 13, wherein the paisley pattern shaped plain weave zone formed in the top fabric layer is aligned between the zigzag lines of double knuckles formed in the bottom fabric layer.

16. The forming fabric of claim 10, wherein the segment of the first, second, and third weft paths that passes over 3 warp yarns in the top fabric layer is aligned in the middle and between the two double knuckles in machine direction formed in the bottom fabric layer.

17. The forming fabric of claim 7, wherein the bottom weft yarns to the right of the first double knuckle in a diagonal has an asymmetrical form creating a broader contact area than the same bottom weft yarn to the left of the first double knuckle in an adjacent diagonal, and wherein the bottom weft yarns to the left of the fourth double knuckle in the diagonal has an asymmetrical form creating a broader contact area than the same bottom weft yarn to the right of the fourth double knuckle in the adjacent diagonal.

18. The forming fabric of claim 17, wherein the bottom weft yarns to the left and right of the second and third double knuckles in the diagonal have a symmetrical form with substantially equal contact areas.

19. The forming fabric of claim 1, wherein the forming fabric has a weft yarn ratio of three top weft yarns to two bottom weft yarn (3:2).

20. A forming fabric comprising a series of repeat units, each of the repeat units comprising:

a set of binding warp yarns including a first set of binding warp yarns and a second set of binding warp yarns, wherein a binding warp yarn from the first set is paired with a binding warp yarn from the second set;

a set of spring warp yarns, wherein each spring warp yarn is arranged between a first pair of binding warp yarns and a second pair of binding warp yarns;

a set of top weft yarns including odd and even top weft yarns, wherein the top weft yarns interweave with the binding warp yarns and the spring warp yarns to form a top fabric layer, wherein the spring warp yarns interweave only with the top weft yarns, and wherein a first pair of binding warp yarns is offset to a second pair of binding warp yarns alternately by at least two top weft yarns and then by at least four top weft yarns;

a set of bottom weft yarns; and a set of bottom warp yarns, the bottom warp yarns interwoven with the bottom weft yarns to form a bottom fabric layer;

wherein the binding warp yarns from the first and second set and the spring warp yarns interweave with the top weft yarns to relatively form a plain weave pattern in defined zones such that (a) the first set of binding warp yarns only pass over odd top weft yarns; (b) the second set of binding warp yarns only pass over even top weft yarns; (c) the first binding warp yarn in the pair is offset from the second binding warp yarn in the pair by at least three top weft yarns to create an overlap in the warp path of the pair of binding warp yarns; and (d) each spring warp yarn passes over even and odd top weft yarns;

wherein the binding warp yarns from the first and second set and the bottom warp yarn interweave with the bottom weft yarns, wherein each spring warp yarn includes a segment in which the spring warp yarn swings toward a first pair of binding warp yarns to push the first pair of binding warp yarns together and a segment in which the spring warp yarn swings toward a second adjacent pair of binding warp yarns to push the second pair of binding warp yarns together.

* * * * *